US007017363B2

(12) United States Patent
Lee et al.

(10) Patent No.: US 7,017,363 B2
(45) Date of Patent: Mar. 28, 2006

(54) ICE SUPPLY SYSTEM OF REFRIGERATOR

(75) Inventors: Myung Ryul Lee, Sungnam-si (KR); Wook Yong Lee, Gwangmyeong-si (KR); Eui Yeop Chung, Seoul (KR); Seung Hwan Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 59 days.

(21) Appl. No.: 10/776,535

(22) Filed: Feb. 12, 2004

(65) Prior Publication Data

US 2005/0044874 A1 Mar. 3, 2005

(30) Foreign Application Priority Data

Aug. 26, 2003 (KR) ..... 10-2003-0059154

(51) Int. Cl.
*F25C 5/04* (2006.01)

(52) U.S. Cl. ..... 62/320; 62/344; 241/DIG. 17

(58) Field of Classification Search ..... 62/320, 62/344; 241/DIG. 17
See application file for complete search history.

(56) References Cited

U.S. PATENT DOCUMENTS 3,640,088 A * 2/1972 Jacobus et al. ..... 62/320
3,889,888 A 6/1975 Prada
4,084,725 A * 4/1978 Buchser ..... 221/75
4,087,140 A 5/1978 Linstromberg
4,997,109 A * 3/1991 Carper ..... 222/146.6
5,037,004 A * 8/1991 Katz et al. ..... 222/146.6
5,056,688 A * 10/1991 Goetz et al. ..... 222/146.6
5,117,654 A * 6/1992 Steffenhagen ..... 62/344
5,273,219 A 12/1993 Beach, Jr. et al.
5,947,342 A * 9/1999 Song ..... 222/413
6,050,097 A 4/2000 Nelson et al.
6,082,130 A 7/2000 Pastryk et al.
6,148,624 A 11/2000 Bishop et al.
6,286,324 B1 9/2001 Pastryk et al.
6,314,745 B1 11/2001 Janke et al.
6,351,958 B1 3/2002 Pastryk et al.
6,438,976 B1 8/2002 Shapiro et al.
6,442,954 B1 9/2002 Shapiro et al.
6,655,166 B1 * 12/2003 Williams ..... 62/320
2001/0025505 A1 10/2001 Nelson et al.

* cited by examiner

*Primary Examiner*—William E. Tapolcai
(74) *Attorney, Agent, or Firm*—Birch, Stewart, Kolasch & Birch, LLP

(57) ABSTRACT

An ice supply system of a refrigerator is provided. The ice supply system of the refrigerator includes an icemaker, a container, a crusher and an ice discharger. The icemaker produces the ice by using cool air of the freezer and drops the ice to a lower part of thereof. The container is provided at a lower part of the icemaker. The container is insertable into and detachable from the door of the refrigerator. The container includes an open top, a first opening at a side thereof, a transfer device rotating and transferring the ice of the first opening, and an outlet for discharging the ice. The crusher crushes the ice transferred by the transfer device and the ice discharger is provided for discharging the ice to an ice chute at the door by controlling a size of an opening of the outlet.

14 Claims, 8 Drawing Sheets

ICE SUPPLY SYSTEM OF REFRIGERATOR

CROSS-REFERENCE TO RELATED APPLICATIONS

This application claims the benefit of Korean Application No. P2003-59154, filed on Aug. 26, 2003, which is hereby incorporated by reference as if fully set forth herein.

BACKGROUND OF THE INVENTION

1. Field of the Invention

The present invention relates to a refrigerator, and more particularly, to an ice supply system provided at the refrigerator for supplying ice to a user at an outside via a dispenser provided at a door.

2. Discussion of the Related Art

A refrigerator is an apparatus for taking storage of foods freshly for a long-term period. Such refrigerator has a food-storage chamber therein. The food-storage chamber is always maintained at a low temperature by a refrigerating cycle for keeping food fresh.

The food-storage chamber is divided into a plurality of storage chambers having different characteristics from each other such that a user can choose a food-storage method in consideration of a kind, a characteristic and an expiration date of food. Typical examples of the storage chambers are a cooling chamber and a freezer.

The cooling chamber keeps a temperature at about 3° C.–4° C. for keeping food and vegetables fresh for a long time. The freezer keeps a temperature at a sub-zero temperature for keeping and storing meat and fish frozen for a long time and making and storing ice. Generally, the cooling chamber is larger than the freezer and the freezer is provided on top of the cooling chamber.

Meanwhile, the refrigerator is developed for performing various additional functions besides a typical function thereof. For example, the user had to open a door and take out a water bottle kept in the cooling chamber to drink cold water kept in the cooling chamber hitherto.

However, a refrigerator having a water dispenser provided at an outside of the door for supplying cold water cooled by cool air of the cooling chamber is developed and the user can drink cold water at outside of the refrigerator without opening the door. Furthermore, a product with water purifying function being added to the water dispenser is being supplied.

The water dispenser generally includes a door enabling to open and close the cooling chamber so as to easily supply water stored in the cooling chamber to an outside thereof. The cooling chamber is provided at a bottom of the freezer and the water dispenser is provided at a relatively lower place. Therefore, there is an inconvenience that the user has to stoop his/her back for using the dispenser.

Meanwhile, the user often uses the ice when the user drinks water or beverage and when the user cooks food. However, in this case, there is an inconvenience that the user has to open the door and separates the ice stored in the ice tray from the ice tray for using the ice. Also, when the door is open for using the ice, cool air in the freezer leaks out to the outside thereof and the temperature of the freezer goes up. Therefore, compressor is required to work more and there is a problem that energy is wasted.

SUMMARY OF THE INVENTION

Accordingly, the present invention is directed to an ice supply system that substantially obviates one or more problems due to limitations and disadvantages of the related art.

An object of the present invention is to provide an ice supply system provided at a refrigerator for a user at an outside thereof to be supplied with ice without opening a door.

Another object of the present invention is to provide an ice supply system of a refrigerator with an improved structure for easily installing and separating a container storing the ice produced from the icemaker.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an ice supply system includes an icemaker, a container, a crusher, and an ice discharger. The icemaker produces ice using cool air of the freezer and drops the ice to a lower part thereof, the container is provided at a lower part of the icemaker for enabling to be inserted into and withdrawn from the door of the refrigerator. In this case, the container includes an open top, a first opening provided at a side, a transfer device rotating and transferring ice to the first opening, and an outlet for discharging ice. The crusher crushes ice transferred by the transfer device and the ice discharger is fixed at the door for controlling an opening/closing amount of the outlet being communicated with an ice chute provided at the door.

In the ice supply system of the refrigerator in accordance with the present invention, the icemaker is provided at the door or in the freezer. The ice supply system of the refrigerator in accordance with the present invention further includes a guide provided at the door for guiding a movement of the container so as to slide the container into the door smoothly.

Meanwhile, the ice supply system of the refrigerator in accordance with the present invention may realize two embodiments according to a structure of the crusher. In the ice supply system of the refrigerator in accordance with the present invention, the crusher is formed as a one piece provided at the door. In the ice supply system of the refrigerator in accordance with the present invention, the crusher provided at the door and the container are formed as two pieces pivotely coupled with each other when the container is inserted into the door.

In the first embodiment, the crusher includes a housing, a crushing member, and a motor. In this case, the housing is provided at the door and has a second opening provided at a side thereof to face the first opening. The crushing member is provided in the housing, is coupled with the transfer device when the container is inserted into the door, and crushes ice using at least one rotary blade. The motor is provided at the door and pivotely coupled with the crushing member.

In the first embodiment, the crushing member includes a shaft coupled with the motor, and rotated and pivotely coupled with the transfer device when the container is inserted into the door, a supporter provided in the housing for supporting the shaft, through which the shaft rotatably passes, and at least one blade coupled with the shaft for crushing the ice transferred into to the housing.

In the first embodiment, the shaft includes a groove provided at an end thereof and the transfer device includes a projection inserted into the groove.

In the mean time, in the second embodiment, the crusher provided at each of the door and the container includes two pieces coupled with each other when the container is inserted into the door.

In the second embodiment, the crusher includes a first housing and second housing, a first crushing member and second crushing member, and a motor. In this case, the first housing is provided in the door and has a second opening provided at a side thereof to face the first opening and the second housing is provided to be adjacent to the first opening in the container. The first crushing member is provided in the first housing and crushes the ice by using at least one rotary blade. The second crushing member is pivotely provided to be pivotely coupled with the transfer device in the second housing, coupled with the first crushing member when the container is inserted into the door, crushes the ice by using at least one rotary blade. The motor is provided at the door and pivotely coupled with the first crushing member.

In the second embodiment, the first and second crushing member pivotely coupled with the motor or the transfer device and provided in the first and second housings for supporting the shaft includes a supporter through which the shaft rotatably passes and at least one blade coupled with the shaft for rotating and crushing the ice transferred into the first and second housings.

In the second embodiment, it is desirable that the shaft of the first crushing member includes a groove at an end thereof and the shaft of the second crushing member includes a projection.

In the mean time, in the ice supply system of the refrigerator of the present invention, the ice discharger includes an actuator receiving a signal of a control member and operating, and a shutter moving in accordance with the actuator for controlling an opening/closing amount of the outlet. In this case, the shutter discharges the ice crushed by the crusher to the ice shutter when the shutter slightly opens the outlet. The shutter directly discharges the ice stored in the container when the shutter completely opens the outlet.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
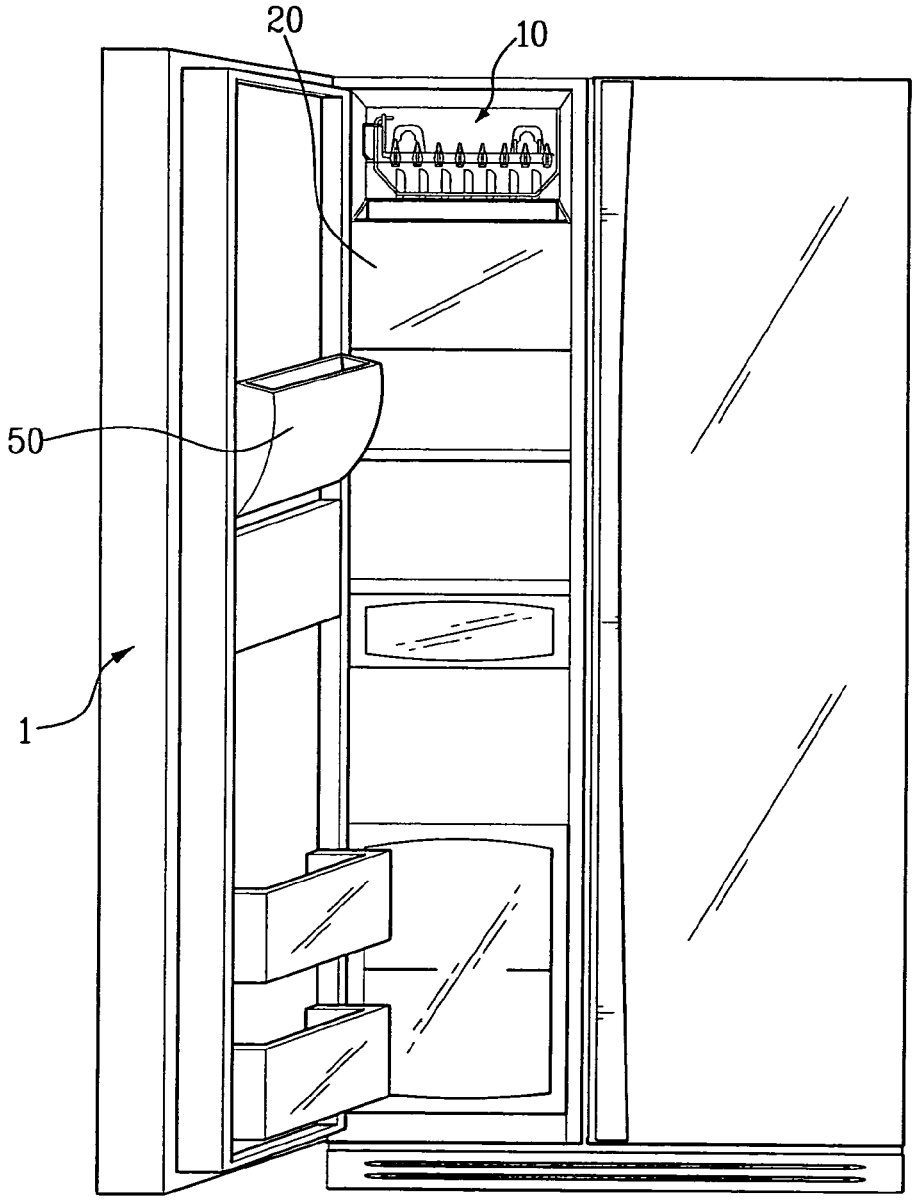
FIG. 1 illustrates a perspective view of a refrigerator with an ice supply system according to the present invention.

FIG. 1 illustrates a perspective view of a refrigerator with an ice supply system according to the present invention. The refrigerator includes a cooling chamber, a freezer and a door 1 for opening and closing the cooling chamber and the freezer in front thereof. An ice supply system is provided at the door 1 and the freezer. Hereinafter, a structure of the ice supply system according to the present invention will be described in detail referring to FIG. 1 to FIG. 4.

Figure 2:
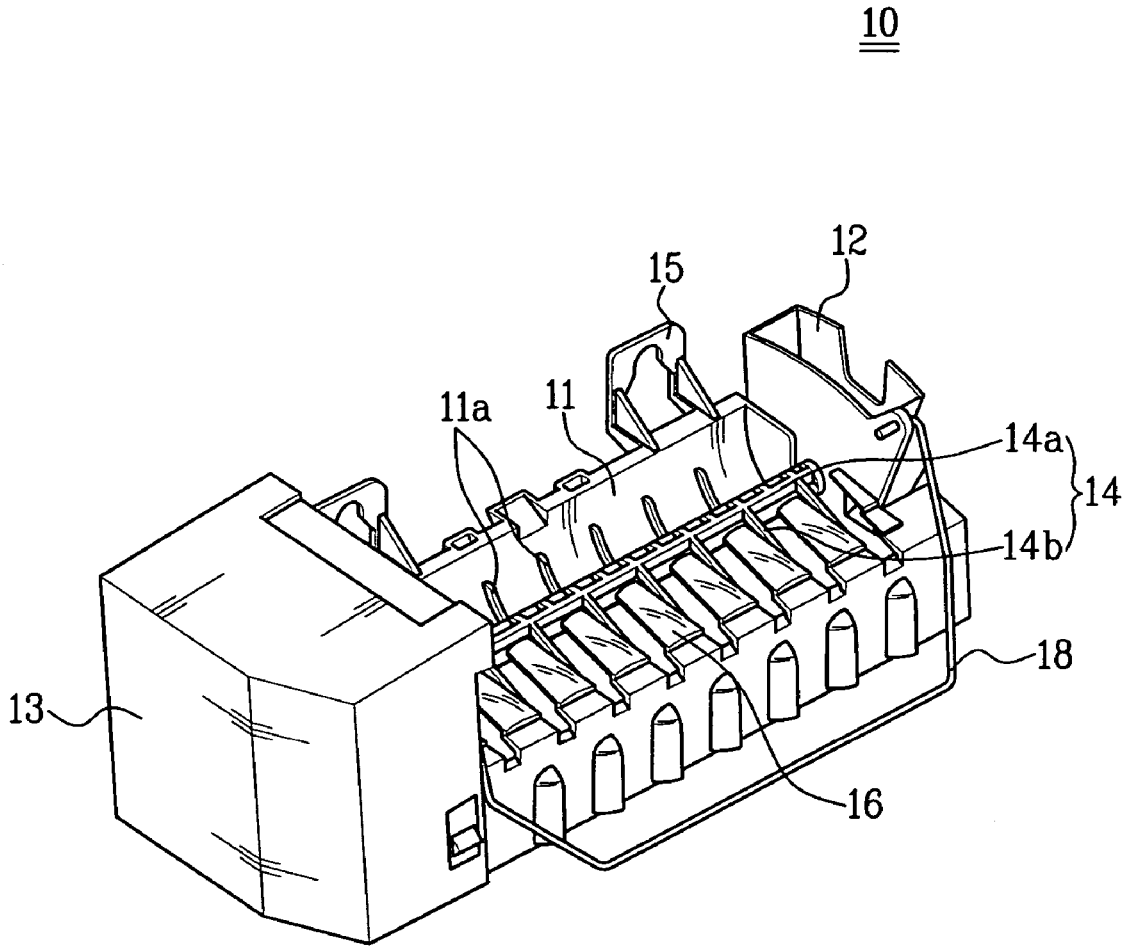
FIG. 2 illustrates a perspective view of an ice supply system provided in the refrigerator of FIG. 1.
Figure 3:
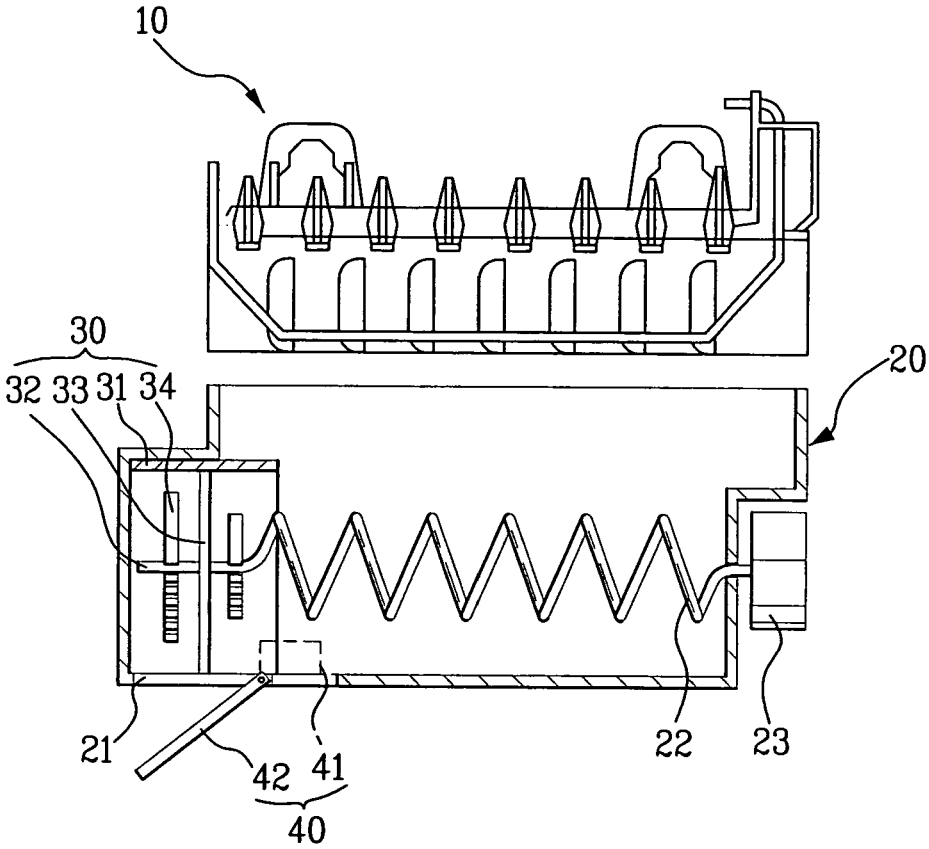
FIG. 3 illustrates a cross-sectional view schematically showing an inside structure of the ice supply system of FIG. 1.
Figure 4:
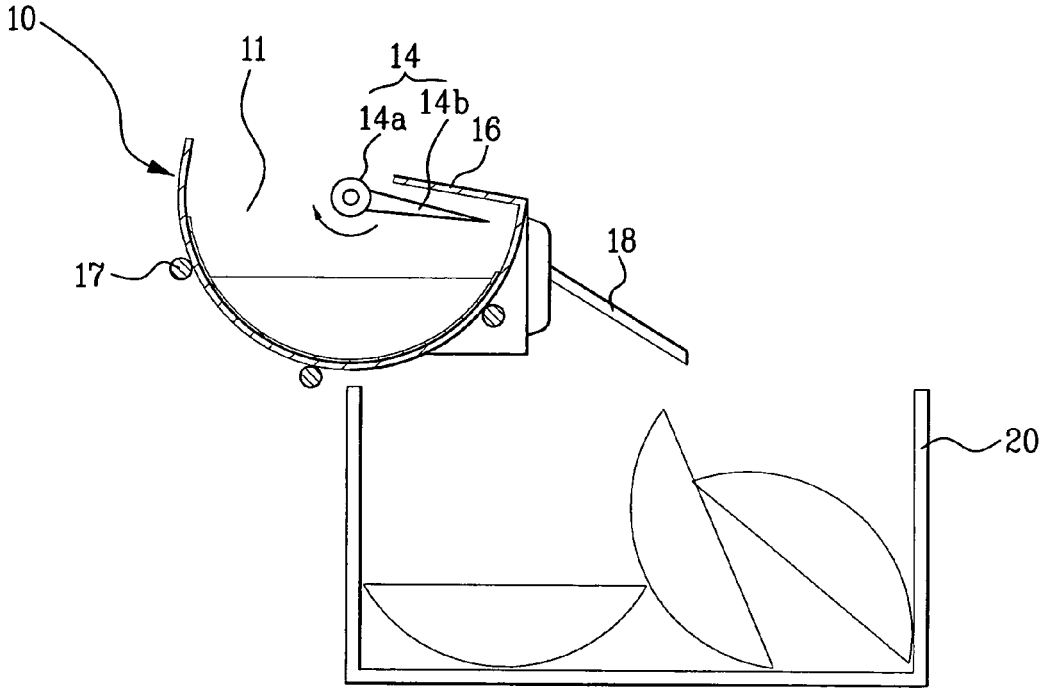
FIG. 4 illustrates a cross-sectional view of an ice container storing ice produced from the icemaker of FIG. 1.

As a reference, FIG. 2 illustrates a perspective view of an ice supply system provided in the refrigerator of FIG. 1. FIG. 3 illustrates a cross-sectional view schematically showing an inside structure of the ice supply system of FIG. 1. FIG. 4 illustrates a cross-sectional view of an ice container storing ice produced from the icemaker of FIG. 1.

Referring to FIG. 1 and FIG. 3, the ice supply system includes an icemaker 10, a container 20 for storing ice produced from the icemaker 10, a crusher 30 for crushing the ice stored in the container 20, and an ice discharger 40 for discharging the ice crushed in the crusher 30 or stored in the container. An ice chute 50 is provided at the door 1 for guiding the ice discharged by the ice discharger 40 to an outside of the door 1. An ice dispenser (not illustrated) is provided at an end of the ice chute 50.

The icemaker 10 is provided at the cooling chamber as illustrated in FIG. 1. The icemaker includes an ice tray 11, a water supplier 12, an ejector 14, and a motor 13 as illustrated in FIG. 2.

The ice tray 11 has an open top as illustrated in FIG. 2 and FIG. 4. An interior of the ice tray 11 is formed in a semi-cylindrical form for storing water and ice. A plurality of ribs 11*a* is provided in the ice tray 11 for dividing the interior space into a plurality of sections. The plurality of ribs 11*a* protrudes in a radius direction as illustrated in FIG. 2. The plurality of ribs 11*a* helps the ice tray 11 producing a plurality of little pieces of ice.

The water supplier 12 is provided at a side of the ice tray 11 as illustrated in FIG. 2 and performs a role of supplying water to the ice tray 11. A bracket 15 is provided to fix the icemaker 10 to the freezer as illustrated in FIG. 2.

Meanwhile, the ejector 14 includes a shaft 14*a* and a plurality of fins 14*b*. The shaft 14*a* as a central axis of the ejector 14 is placed to cross the center along the longitudinal direction at an upper inside of the ice tray 11. The plurality of fins 14*b* is perpendicularly provided on an outer circumferential surface of the shaft 14*a*. It is desirable that the plurality of fins 14*b* is provided at a same interval along a longitudinal direction of the shaft 14*a*. Particularly, each of the plurality of fins is provided in each section arranged in the ice tray 11.

The motor 13 is provided at a point of an outer circumferential surface of the ice tray 11 to be pivotly connected to the shaft. Accordingly, when the shaft 14*a* is rotated via the motor 13, the plurality of fins 14*b* are rotated together. Each of the plurality of fins 14*b* pushes the ice in the ice tray 11 so as to drop the ice onto a lower part of the icemaker 10.

Referring to FIG. 3, a plurality of strips 16 is provided in a front part of the ice tray 11, i.e., at an upper end of a side opposite to a side where the bracket 15 is provided. Each of the plurality of strips 16 is extended from a front upper part of the ice tray 11 to a part around the shaft 14*a*. In this case, there is a little gap between each of the plurality of strips 16. The fins pass through the gap when the shaft 14*a* is rotated.

In the mean time, the ice in the ice tray 11 is pushed by the shaft 14*a*, separated from the ice tray 11 and dropped onto the plurality of strips 16 after being separated completely when the shaft 14*a* is rotated. The ices dropped onto the plurality of strips 16 are dropped again onto the lower part of the icemaker 10 to be stored in the ice container 20 provided at the lower part of the icemaker 10. Accordingly, an upper surface of the plurality of strips 16 guides the ice separated from the ice tray 11 to the lower part of the plurality of strips 16. Therefore, it is desirable that a side of the plurality of strips 16 adjacent to the shaft 14*a* slopes toward one side and thus the side of the plurality of strips 16 near the shaft 14*a* is arranged at a higher place than a front side of the ice tray 11.

A structure is required for preventing the ice from being dropped to a rear side of the ice tray 11, the ice separated from the ice tray 11. For this, it is desirable that a rear end of the ice tray 11 is provided to be higher than the shaft 14*a* as illustrated in FIG. 3 according to the present invention. Then, the ice moved to the rear side of the ice tray 11 by the plurality of fins 14*b* and separated from the ice tray 11 are smoothly guided to the front side of the ice tray 11 and dropped onto the upper surface of the plurality of strips 16.

Meanwhile, a heater 17 is provided at a lower surface of the ice tray 11 as illustrated in FIG. 4. The heater 17 heats a surface of the ice tray 11 for a short time and slightly melts the ice on the surface of the ice tray 11. Accordingly, the ices in the ice tray are easily separated when the shaft 14*a* and the plurality of fins 14*b* rotate.

Referring to FIG. 2 to FIG. 4, a sensing arm 18 is provided in the icemaker 10 for estimating an amount of ices stored in the container 20. The sensing arm 18 is controlled by a controller (not illustrated) and moved up and down so as to estimate the amount of ices stored in the container 20. For example, the sensing arm 18 periodically descends. Descending amount is large when a small amount of ices is stored in the container 20. On the other hand, the sensing arm 18 is bumped into the ice and thus descending amount is small when a large amount of ices are stored in the container 20. Accordingly, the controller estimates the amount of ice in the ice container 20 with a descended amount.

Meanwhile, the container 20 provided at a lower part of the icemaker 10 has an open top for receiving and storing the ice dropped from the icemaker 10 as illustrated in FIG. 1 and FIG. 3. An outlet 21 is provided on a side of the ice container 20, for example, on a floor for discharging the ice to a lower part thereof as illustrated in FIG. 3.

In the mean time, a transfer device 22 is provided in the ice container 20 for transferring the ice stored in the container 20 toward a side of the outlet 21. The transfer device 22 is formed in a zigzag form and provided to cross an inside of the container 20. The transfer device 22 coupled with the motor 23 rotates and transfers the ice stored in the container 20 toward the side of the outlet 21.

Referring to FIG. 3, a crusher 30 is provided at the side of the outlet 21 in the container 20. The crusher 30 includes a housing 31, a shaft 32, a supporter 33 and a blade 34. The housing 31 is provided on top of the outlet 21 in the container 20 and a surface, i.e., a side facing the transfer device 22 is formed in an opened form. The shaft 32 is perpendicularly provided in the housing 31 and coupled with and rotated together with the transfer device 22.

The shaft 32 may be fabricated separately from the transfer device 22, and connected to the transfer device 22, or, as shown in FIG. 3, fabricated in a form extended from an end of the transfer device 22.

The supporter 33 is provided to support the shaft 32 in the housing 31 as illustrated in FIG. 3. That is, since the shaft 32 passes through the supporter 33, the shaft 32 rotates in the housing 31 together with the transfer device 22.

The blade 34 coupled with the shaft 32 crushes the ice transferred by the transfer device 22 rotating together with the shaft 32. At least one blade 34 is provided. When a plurality of the blades is provided, it is desirable that the plurality of blades is provided at both sides around the supporter 33.

The ice discharger 40 includes an actuator 41 and a shutter 42. In this case, the shutter 42. The shutter 42 formed in a plate form is provided for opening and closing the outlet 21. The actuator 41 is coupled with the shutter 42 via a lever (not illustrated). In this case, for example, a solenoid type actuator is employed as the actuator 41.

In the ice discharger 40 composed as mentioned above, the actuator 41 operates according to a control signal of the controller and the shutter 42 controls an amount of opening and closing of the outlet 21 according to the actuator 41.

Meanwhile, an ice chute 50 is provided at the container 20, in more detail, at a lower part of the outlet 21 as illustrated in FIG. 1. The ice chute 50 is provided to pass through the door 1. Thus the ice discharged through the discharger 21 is guided to an outside of the door 1. Meanwhile, although it is not illustrated, an ice dispenser is provided at an end of the ice chute 50. The ice dispenser blocks the ice chute 50 from the outside of the door 1 and supplies the ice when the user wants to use the ice.

Meanwhile, the outlet 123 may be provided in the housing 31 of the crusher 30, not on the floor of the container 20. In this case, a part of the floor adjacent to a first opening 121 of the container 20 needs to be completely opened.

Hereinafter, an operation of the ice supply system of the refrigerator will be described according to the present invention composed as mentioned above. First, when the controller (not illustrated) determines that the amount of ice in the container 20 are not enough by an operation of the sensing arm 18, water is supplied to the water supplier 12 of the icemaker 10. The water supplied to the water supplier 12 is filled in the spaces between the ribs 11*a* of the ice tray 11 and frozen by cold air of the freezer. Therefore, a plurality of pieces of ice in a regular size is produced via the ribs 11*a* in the ice tray 11.

When a predetermined time passes and the ice is produced, the heater 17 is heated for a short period of time. Accordingly, an exterior of the ice tray 11 is slightly melted and each piece of ice is separated from the ice tray 11. And, the motor 13 starts to operate and the shaft 14*a* and the plurality of fins 14*b* are rotated together. Then, the plurality of fins 14*b* pushes the ice between each of the plurality of ribs the ribs 11*a* in a circumference direction of the ice tray 11 and the ice completely separated from the ice tray 11 via the plurality of fins 14*b* is dropped onto the plurality of strips 16 and subsequently onto the lower part of the icemaker 10. The ice dropped to the lower part of the icemaker 10 is stored in the container 20.

When a predetermined amount of the ice is filled in the container 20 by repeating above process, the sensing arm 18 detects the amount of the ice and the controller stops producing ice. Of course, when it is determined via the sensing arm 18 that the ice is not enough, the process is repeated to continue producing the ice and the produced ice is stored in the container 20.

Meanwhile, if a user manipulates the control panel provided on an outer surface of the door 10 when the container 20 is filled with the ice, the user is supplied with crushed or uncrushed ice in a large size through the ice dispenser. Hereinafter, the process will be described.

When the user manipulates the control panel to select a function of supplying the ice, the motor 23 rotates and transfers a large piece of ice stored in the container 20 to the crusher 30. The large piece of ice transferred to the crusher 30 is crushed into little pieces. Meanwhile, when the crushed ice is supplied through the ice dispenser, the shutter 42 slightly opens the outlet 21. The crushed ice is discharged through the outlet 21 provided at the lower part of the crusher 30. The crushed ice passes through the ice chute 2 and supplied to the user through the ice dispenser.

On the other hand, when the user manipulates the control panel to select a function for supplying a large piece of uncrushed ice, the shutter 42 mostly opens the outlet 21. And, when the motor 23 operates and the transferring device 22 rotates, the large piece of ice stored in the container 20 is transferred to the crusher 30. At this time, the large piece of uncrushed ice is discharged through the outlet 21 before reaching the crusher 30, passes through the ice chute 50 and supplied to the user through the ice dispenser.

Using the refrigerator with the ice supply system according to the present invention as mentioned above, the user is selectively supplied with crushed or uncrushed ice. Nevertheless of this advantage, the ice supply system according to the present invention has a few disadvantages described referring to FIG. 1 to FIG. 4.

First, parts such as the motor and the actuator operated by an electricity are provided in the container. Accordingly, There is an inconvenience in cleaning the container. For separating the container from the door, connectors of the electric parts need to be separated first before cleaning and connected back when the container is installed back after the cleaning.

Second, there is a danger of an electric shock if the user touches the connectors of the electric parts with a wet hand when the refrigerator is turned on by a mistake of the user. The user needs to be cautious not to wet the motor and the connector while cleaning the container.

Third, the crusher and the motor are provided in the container and the container becomes heavy. Accordingly, there is a problem in that it is not simple for the old and the weak to separate the container from the door for cleaning and to reinstall the container back to the door after cleaning.

Accordingly, the refrigerator with an ice supply system having an improved structure is provided to solve the problem. In FIG. 5 to FIG. 8, the ice supply system having the improved structure according to the present invention is illustrated. Hereinafter, the ice supply system with the improved structure will be described in more detail referring to the drawings.

Figure 5:
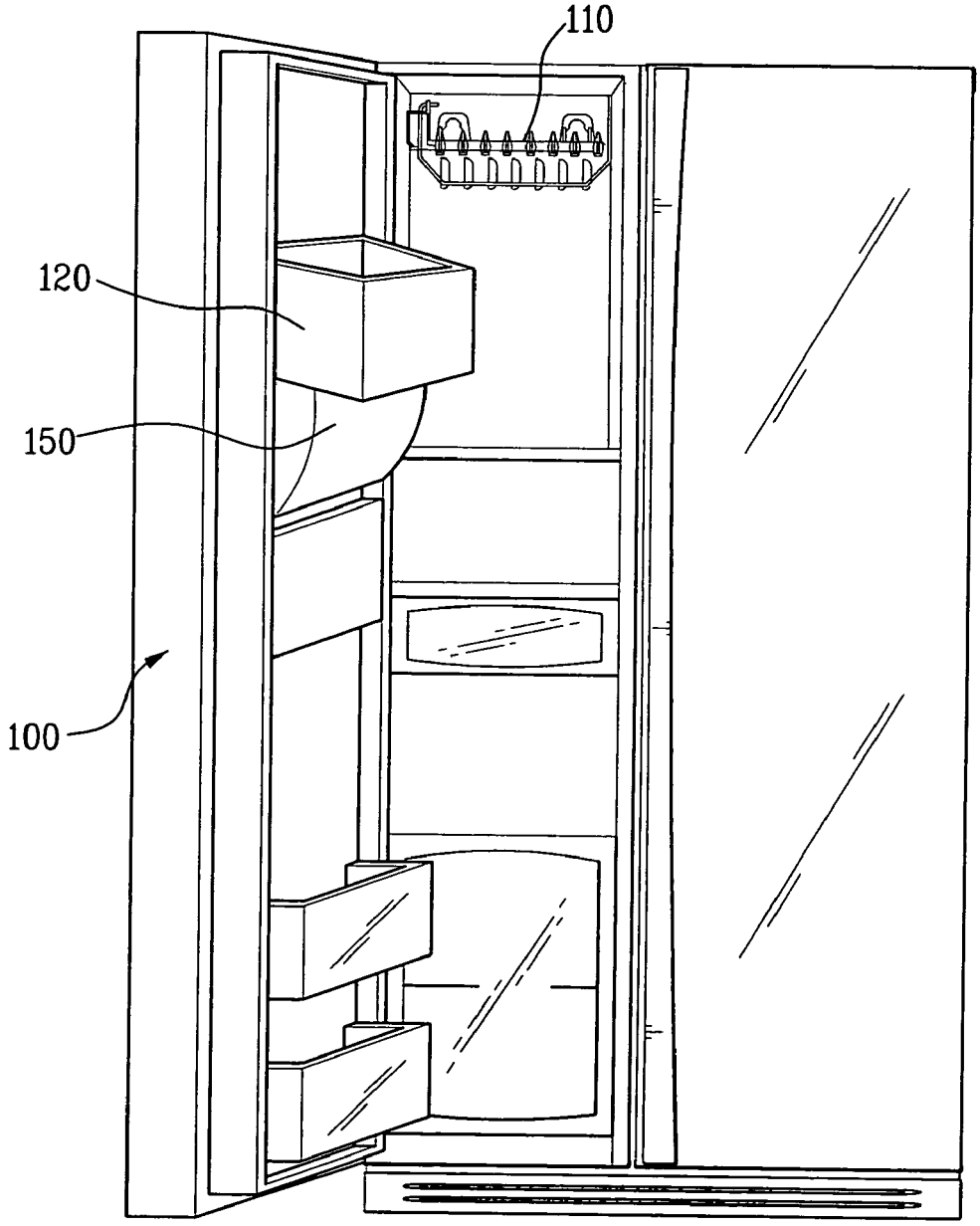
FIG. 5 illustrates a perspective view of a refrigerator with an ice supply system, the refrigerator having an improved structure according to the present invention.

Referring to FIG. 5, the refrigerator with the ice supply system having the improved structure according to the present invention includes the cooling chamber, the freezer, and a door 100 provided in front thereof for opening and closing the cooling chamber and the freezer. An icemaker 110 is provided in the door 100 adjacent to an interior of the freezer or the freezer. FIG. 5 illustrates an embodiment of the icemaker provided in the freezer. A structure of the icemaker 110 provided as mentioned above is the same as described with reference to FIG. 1 to FIG. 4 and will be omitted.

Referring to FIG. 5, a container 120 is provided in the door 100. The container 120 is provided under the icemaker 110 enabling to be inserted into or withdrawn from the door 100 by being slid when the door 100 is closed.

Figure 6:
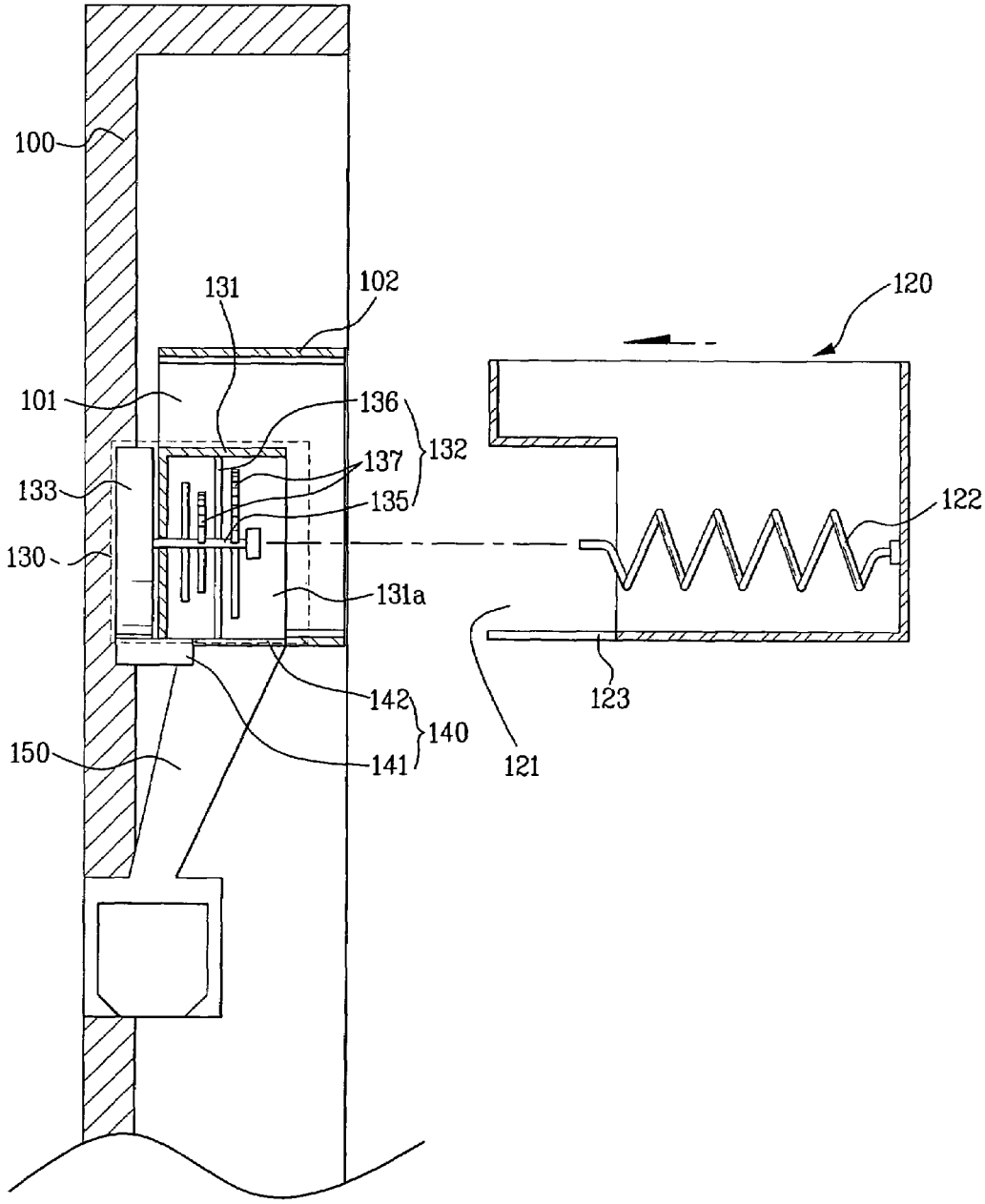
FIG. 6 illustrates a cross-sectional view of a refrigerator with an ice supply system, the refrigerator having an improved structure according to a first embodiment of the present invention.
Figure 7:
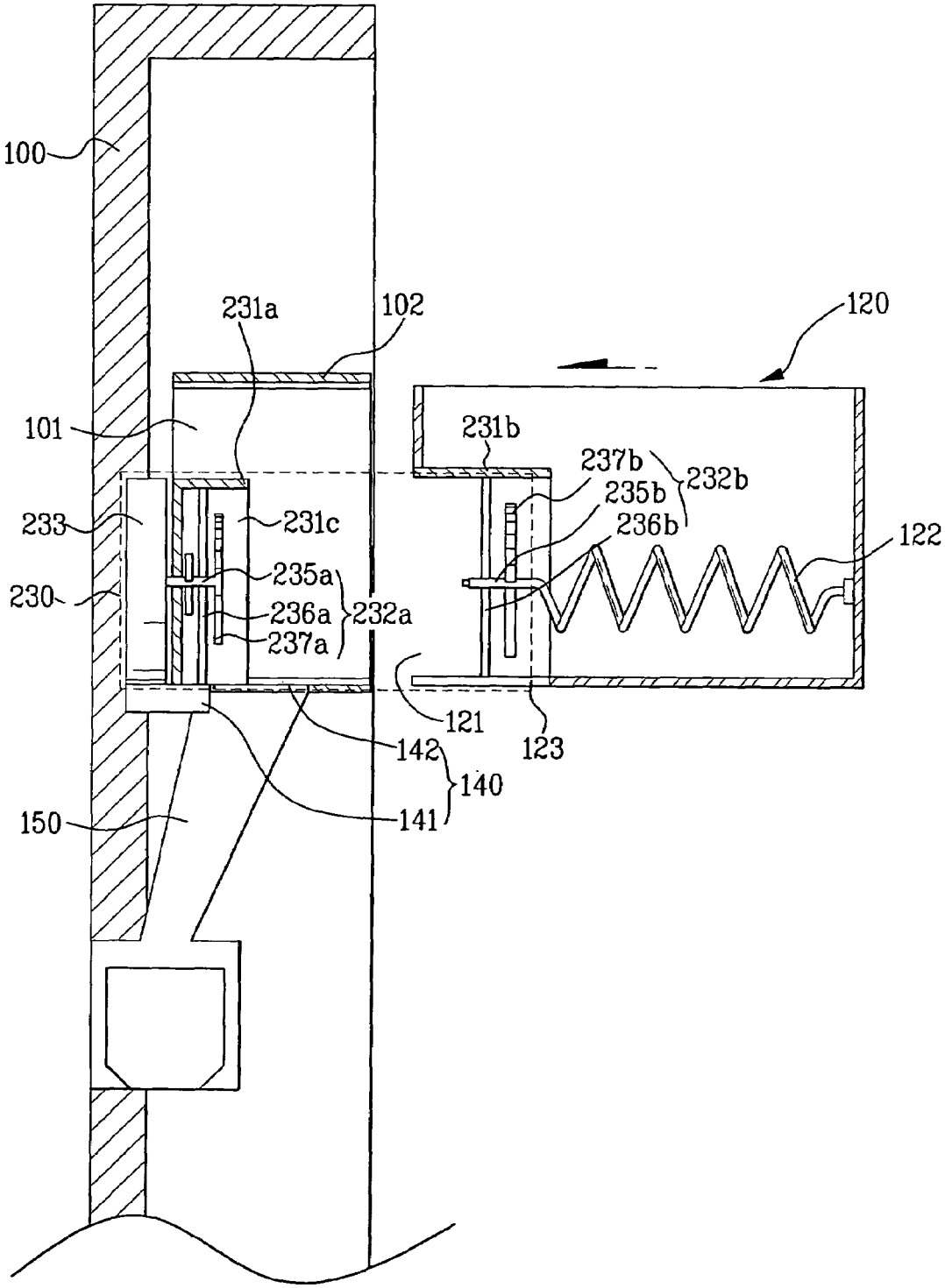
FIG. 7 illustrates a cross-sectional view of an ice supply system with an improved structure according to a second embodiment of the present invention.

The container 120 includes an open top for receiving the ice dropped from the icemaker 110 as illustrated in FIG. 6 and FIG. 7. The first opening 121 is provided on a side, i.e., a side facing the door 100 for communicating the interior of the container 120 with an outside thereof when the container is inserted into the door 100. A discharger 123 is provided on a floor of the container 120 for dropping the ice onto the lower part thereof. In this case, it is desirable that the discharger 123 is provided adjacent to the fist opening 121.

Referring to FIGS. 6 and 7, a transfer device 122 is provided in the container 120. A first end of the transfer device 122 is rotatably provided on an inner surface of the container 120 and a second end thereof is provided adjacent to the first opening 121. The transfer device 122 provided as mentioned above rotates and transfers the ice stored in the container 120 toward the discharger 123 and the first opening 121.

Meanwhile, the container 120 may be inserted into the door 100 or withdrawn from the door 100. For this, a cavity 101 is provided at the door 100 for receiving the container 120 as illustrated in FIGS. 6 and 7. The cavity 101 is provided in a concave form on a side adjacent to the freezer when the door 100 is closed. The cavity 101 further includes a guide 102 provided at a part, i.e., an upper part thereof for guiding a sliding movement of the container 120 such that the container 120 is smoothly inserted into and withdrawn from the door 100.

In the mean time, it is desirable that a surface of the cavity 101 and an outer surface of the container 120 are engaged with each other for preventing the container 120 inserted into door 100 from being come out from the cavity 101 when the door 100 is opened or closed. Of course, a structure may be introduced for fixing the container 120 by simply using a separate fixing means after the container 120 is inserted into the cavity 101.

Referring to FIGS. 6 and 7, an ice chute 150 is provided in the door 100 for communicating the cavity 101 and an outer surface of the door 100.

In the mean time, the ice supply system with an improved structure in accordance with the present invention may realize two embodiments according to a structure of a crusher 130 and 230 crushing the ice transferred via the transfer device 122. Each embodiment is illustrated in FIG. 6 and FIG. 7. Hereinafter, the structure of the crusher 130 and 230 will be described referring to the drawings.

FIG. 6 illustrates an ice supply system in accordance with a fist embodiment of the present invention. Referring to FIG. 6, the crusher 130 is provided in the cavity 130 of the door 100. The crusher 130 and the cavity 101 are formed as a single piece. The crusher 130 includes a housing 131, a crushing part 132, and a motor 133.

The housing 131 is provided in the cavity 101. A second opening 131*a* is provided on a side of the housing 131 facing the first opening 121 of the container 120. A lower part of the housing 131 is communicated with the ice chute 150. For this, a hole is provided on a floor of the housing 131. Of course, the housing 131 may be provided without the floor and a side of the housing 131 may be directly fixed on a lower surface of the cavity 101 as illustrated in FIG. 6. If the housing 131 is structured as mentioned above, the interior of the housing 131 is communicated with the ice chute 150 and the ice crushed in the crusher 130 is discharged to a the ice chute 150. Meanwhile, it is desirable that the housing 131 is inserted into the first opening 121 when the container 120 is inserted into the cavity 101 of the door 100 in the first embodiment. Since the first opening 121 is provided at the container 120 and the second opening 131*a* is provided at the housing 131, the interior of the housing 131 and the interior of the container 120 are communicated with each other when the container 120 is inserted into the cavity 101.

The crushing member 132 is provided in the housing 131 and includes a shaft 135, a supporter 136, and a blade 137. A first end of the shaft 135 is coupled with the motor 133 and a second end of the shaft 135 is coupled with the transfer device 122 when the container 120 is inserted into the cavity 101. The supporter 136 is provided in the housing 131 for supporting the shaft 135. For this, at least one end of the supporter 136 is fixed on or is in contact with an inner surface of the housing 131. The shaft 135 is arranged to pass through the supporter 136. The shaft 135 is supported by the supporter 136, and rotated by the motor 133. Meanwhile, at least one blade 137 is pivotly coupled with the shaft 135 and crushes the ice being rotated together with the shaft 135 when the motor 133 is operated. It is desirable that a same number of a plurality of the blades 137 is provided on both sides from the center of the supporter 136. The motor 133 is arranged on an outside of the housing 131 and provided at the door 100.

Figure 8:
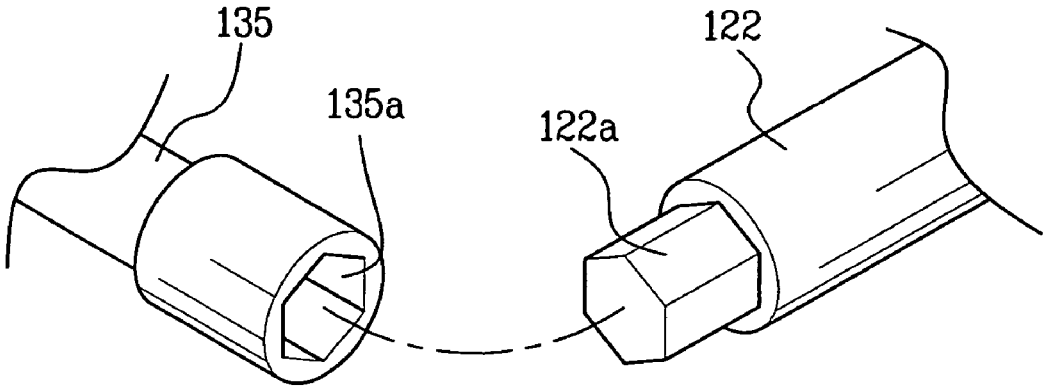
FIG. 8 illustrates a cross-sectional perspective view showing a coupling structure for a shaft a crusher and a transfer device of a container in the ice supply system of FIG. 6.

Meanwhile, the crusher 132 is coupled with the transfer device 122 when the container 120 is inserted into the cavity 101 in the ice supply system of the refrigerator in accordance with the present invention. For this, a structure is provided in the present invention for pivotly coupling the shaft 135 of the crusher 130 with the transfer device 122 of the container 120. Hereinafter, the structure will be described referring to FIG. 8. Referring to FIG. 8, a groove 135*a* is provided at a first end of the shaft 135 and a projection 122*a* inserted into the groove 135*a* is provided at the first end of the shaft 135. In this case, the groove 135*a* is provided at the first end of the shaft 135 positioned on a side of the second opening 131*a*. The projection 122*a* is provided at a first end of the transfer device 122 positioned at a side of the first opening.

If the groove 135*a* and projection 122*a* are provided at the shaft 135 and the transfer device 122, the projection 122*a* is inserted into the groove 135*a* when the container 130 is inserted into the cavity 101. Accordingly, when the shaft 135 is pivotly coupled with the transfer device 122, and the motor 133 is operated, the shaft 135 is rotated together with the transfer device 122. Meanwhile, it is desirable that the groove 135*a* and the projection 122*a* are formed in a polygon form for preventing the shaft 135 and the transfer device 122 from being run idle when the motor 133 is operated. FIG. 8 illustrates an embodiment showing the groove 135*a* and the projection 122*a* are formed in a hexagon form. In the mean time, a location of the grove and the projection may be changed to each other.

The ice supply system having the structure as mentioned above in accordance with the first embodiment of the present invention employs the container 120 when the cavity 101 of the door 100 is inserted into the cavity 101. In the first embodiment, when the container 120 is installed to the door 100, the transfer device 122 is pivotly coupled to and rotated together with the crusher 132 when the motor 133 is rotated. Accordingly, the ice supply system in accordance with the first embodiment performs a same function as the embodiment described with reference to FIG. 1 to FIG. 4.

Meanwhile, referring to FIG. 7, in the ice supply system of the refrigerator in accordance with the second embodiment of the present invention, the crusher 230 includes two pieces. In this case, one piece is provided at the door 100 and the other piece is provided at the container 120. When the container 120 is inserted into the cavity 101 of the door, the container 120 is pivotely coupled with the cavity 101 of the door 100 to composer one complete crusher 230.

Referring to FIG. 7, the crusher 230 of the ice supply system in accordance with the second embodiment includes a first housing 231*a*, a second housing 231*b*, a first crushing member 232*a*, a second crushing member 232*b* and a motor 233. The housing receiving the crushing member in the second embodiment is composed of two pieces, which makes it different from the housing composed of one piece in the first embodiment. The first housing being one of the two pieces provided in the cavity 101 of the door 100 includes a second opening 231*c* on a side facing the first opening 121 of the container 120. The second housing 231*b* is provided to be adjacent to the first opening 121 in the container 120 as illustrated in FIG. 7. In this case, an interior of the housing 231*b* is communicated with the interior of the container 120 such that the ice in the container 120 is freely transferred into an interior of the second housing 231*b*.

Meanwhile, when the container 120 is inserted into the cavity 101 of the door 100, it is desirable that the first housing 231*a* is passed through the first opening 121 and inserted into the second housing 231*b*. If the first housing 231*a* and the second housing 231*b* are provided as mentioned above, when the container 120 is inserted into the cavity 101 of the door, the first housing 231*a* and the second housing 231*b* are coupled with each other to form a complete body having an empty space therein. Of course, the empty space formed in the interior of the first and second housings 231*a* and 231*b* is communicated with the ice chute 150 through the discharger 123 of the container 120 when the container 120 is inserted into the cavity 101.

The first crushing member 232*a* is provided in the first housing 231*a* and the second crushing member 232*b* is provided in the second housing 231*b*. In this case, each of the first crushing member 232*a* and the second crushing member 232*b* crushes the ice using at least one rotary blade 237*a* and 237*b* and includes a shaft 235*a* and 235*b*, a supporter 236*a* and 236*b*, and the blade 237*a* and 237*b*. Hereinafter, the shaft of the first crushing member 232*a* and the shaft of the second crushing member 232*b* are named as a first shaft 235*a* and a second shaft 235*b*, relatively. A supporter of the first crushing member 232*a* and a supporter of the second crushing member 232*b* are named as a first supporter 236*a* and a second supporter 236*b*. A blade of a first crushing member 232*a* and a blade of a second crushing member 232*b* are named as a first blade 237*a* and a second blade 237*b*, relatively.

The first shaft 235*a* is pivotely coupled with the motor 233 as illustrated in FIG. 7 and the second shaft 235*b* is pivotely coupled with the transfer device 122. The first supporter 236*a* is provided to pass through the first housing

231*a* for rotatably supporting the first shaft 235*a*. In other words, the first shaft 235*a* rotatably pass through the fist supporter 236*a*. In the mean time, the second supporter 236*b* is provided to pass through the interior of the second housing 231*b* for rotatably supporting the second shaft 235*b*. The first blade 237*a* is coupled with the first shaft 235*a* and provided to rotate with the first shaft 235*a*. The second blade 237*b* is coupled with the second shaft 236*b* and provided to rotate with the second shaft 235*b*. Meanwhile, the motor 233 is provided at the door 100 as illustrated in FIG. 7 and povotly coupled with the first crushing member, in more detail, the first shaft 235*a*.

In the ice supply system composed as mentioned above in accordance with the second embodiment, when the container 120 is inserted into the cavity 101, the first crushing member 232*a* and the second crushing member 232*b* are pivotely coupled with each other. Accordingly, the first crushing member 232*a*, the second crushing member 232*b* and the transfer device 122 are rotated together when the motor 233 is operated. For this, as the same as in the first embodiment, a structure is provided for preventing the first crushing member 232*a* and the second crushing member 232*b* are running idle in the second embodiment. A groove is provided at an end of the first shaft 235*a* provided at a side of the second opening 231*c*. A projection is provided at an end of the second shaft 235*b* provided at a side of the first opening 121. In this case, the structure of the groove and the projection is the same as the example described with reference to FIG. 8 and will be omitted.

In the mean time, in the ice supply system of the refrigerator in accordance with the present invention, an ice discharger 140 is provide at a lower part of the discharger 123 of the container 120 as illustrated in FIG. 6 and FIG. 7. The ice discharger 140 includes an actuator 141 and a shutter 142. The shutter 142 is formed as a plate form or an arc form for opening and closing the discharger 123. The actuator 141 is coupled with the shutter 142 by a lever (not illustrated). In this case, a solenoid type actuator, for example, is employed as the actuator 141. In the ice discharger 140 composed as mentioned above, the actuator 141 is operated according to a control signal of the controller and the shutter 142 moving in accordance with the actuator 141 controls an amount of the opening and closing of the outlet 123. In this case, the discharger 140 discharges the ice crushed by the crusher 230 to the ice shutter 142 when the shutter 142 slightly opens the outlet 123. The ice discharger 140 directly discharges the ice stored in the ice container 120 when the shutter 142 completely opens the outlet 123.

In the mean time, an ice chute 150 is provided at a lower part of the outlet 123 of the container 120 as mentioned above. The ice chute 150 is provided to pass through the door 100 and ice discharged through the outlet 123 is guided to an outside of the door 100. Meanwhile, although not illustrated, an ice dispenser is provided at an end of the ice chute 150. The ice dispenser blocks the ice chute 150 from the outside of the door 100 and supplies a predetermined amount of ice to a user when the user wants to use the ice.

In the ice supply system composed as mentioned above in accordance with the present invention, the user can be supplied with the ice at an outside of the refrigerator without opening the door. The user is supplied with the ice crushed by the crusher or large piece of uncrushed ice produced from the icemaker 110, and stored in the container 120 by manipulating a selection button. The process is the same as described with reference to FIG. 1 to FIG. 4 and will be omitted.

The ice supply system of the refrigerator in accordance with the present invention has an advantage as follows.

First, in the ice supply system in accordance with the first and second embodiments, a structural element of an electric part or electric connector is provided at the door and the container for storing the ice is inserted into the door or has a structure to be withdrawn.

In this case, a separate electric part or electric connector is not provided at the container. Accordingly, there is no danger of electric shock when the container is installed for use or separated from the door for cleaning.

Second, the ice supply system in accordance with the first and second embodiments has a structure for installing or separating the container to the cavity of the door by sliding. When the container is installed at the door, the transfer device and the crushing member of the crusher are automatically and pivotely coupled with each other. Accordingly, it is easy and convenient to install or separate the container.

Third, in the ice supply system in accordance with the first and second embodiments, the electric parts such as the motor or the actuator and electric connectors for the electric parts are not provided at the container. Accordingly, weight of the container is light and anyone can easily install or separate the container.

Fourth, in the ice supply system in accordance with the present invention, the user is supplied with the ice at the outside of the refrigerator. Accordingly, cool air in the freezer and the cooling chamber is not leaked and energy consumption is reduced.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An ice supply system of a refrigerator, comprising:

an icemaker for producing ice using cool air of the freezer;

a container, the container being insertable into and detachable from a door of the refrigerator, the container comprising:

an open top;

a first opening on a side of the container;

a transfer device for rotating and transferring ice to the first opening; and an outlet for discharging ice;

a crusher for crushing ice transferred by the transfer device; and an ice discharger located on the door for adjusting a size of an opening of the outlet, the outlet being communicated with an ice chute within the door.

2. The ice supply system of the refrigerator of claim 1, wherein the icemaker is located adjacent to the door.

3. The ice supply system of the refrigerator of claim 1, wherein the icemaker is in the freezer.

4. The ice supply system of the refrigerator of claim 1, further comprising a guide on the door for guiding a movement of the container so as to insert the container into the door smoothly.

5. The ice supply system of the refrigerator of claim 1, wherein the crusher is formed as one piece and is located on the door.

6. The ice supply system of the refrigerator of claim 5, wherein the crusher comprises:

a housing located on the door, the housing having a second opening at a side thereof to face the first opening;

a crushing member within the housing, the crushing member being coupled with the transfer device when the container is inserted into the door, and crushing ice using at least one rotary blade; and a motor coupled with the crushing member.

7. The ice supply system of the refrigerator of claim 6, wherein the crushing member comprises:

a shaft coupled with the motor, the shaft being rotatably coupled with the transfer device when the container is inserted into the door; and a supporter in the housing for supporting the shaft, the shaft rotatably passing through the supporter, the at least one blade being coupled with the shaft for crushing the ice transferred into the housing.

8. The ice supply system of the refrigerator of claim 7, wherein the shaft comprises a groove and the transfer device comprises a projection inserted into the groove.

9. The ice supply system of the refrigerator of claim 1, wherein the ice discharger comprises:

an actuator operated in accordance with a signal of a controlling member; and a shutter moved by the actuator for adjusting the size of the opening of the outlet.

10. The ice supply system of the refrigerator of claim 9, wherein the ice discharger discharges ice crushed by the crusher to the ice shutter when the shutter slightly opens the outlet and the ice discharger directly discharges ice stored in the container when the shutter completely opens the outlet.

11. The ice supply system of the refrigerator of claim 1, wherein the crusher is located on the door, and the crusher is formed as two pieces coupled with each other.

12. The ice supply system of the refrigerator of claim 11, wherein the crusher comprises:

a first housing located on the door, the first housing having a second opening on a side of the first housing to face the first opening;

a first crushing member in the housing crushing ice using at least one rotary blade of the first crushing member;

a second housing in the container adjacent to the first opening;

a second crushing member in the second housing being coupled with the transfer device, for being coupled with the first crushing member when the container is inserted into the door, and crushing ice using at least one rotary blade of the second crushing member; and a motor coupled with the first crushing member.

13. The ice supply system of the refrigerator of claim 12, wherein each of the first and second crushing members comprises:

a shaft being coupled with and rotating together with the motor or the transfer device; and a supporter provided to support the shaft in each of the first and second housings through which the shaft rotatably passes, the at least one blade being coupled with the shaft, the at least one blade rotating for crushing the ice transferred into the first or second housing.

14. The ice supply system of the refrigerator of claim 13, wherein the shaft of the first crushing member comprises a groove in a side thereof and the shaft of the second crushing member comprises a projection inserted into the groove.

* * * * *